United States Patent [19]

Van Gompel

[11] 4,160,531

[45] Jul. 10, 1979

[54] APPARATUS AND METHODS FOR UNTELESCOPING AND REWINDING REELS OF SHEET MATERIAL SUCH AS STEEL

[75] Inventor: James J. Van Gompel, Fremont, Ind.

[73] Assignee: Brammall, Inc., Angola, Ind.

[21] Appl. No.: 845,386

[22] Filed: Oct. 25, 1977

[51] Int. Cl.[2] ..... B21C 47/02; B65H 17/02

[52] U.S. Cl. ..... 242/78.1; 242/67.1 R

[58] Field of Search ..... 242/78.1, 78.8, 78, 242/82, 67.1 R, 75, 54 R, 55.21

[56] References Cited

U.S. PATENT DOCUMENTS

| | | | |
|---|---|---|---|
| 1,136,311 | 4/1915 | Cameron | 242/67.1 R |
| 1,164,586 | 12/1915 | Duvall | 242/67.1 R |
| 1,853,384 | 4/1932 | Snow | 242/67.1 R |
| 2,084,869 | 6/1937 | Rosenberg | 164/22 |
| 2,412,508 | 12/1946 | Jensen | 242/54 R |
| 2,508,977 | 5/1950 | Todd | 153/54 |
| 2,615,646 | 10/1952 | Disler | 242/78 |
| 2,827,245 | 3/1958 | Kleinschmidt | 242/55 |
| 3,244,380 | 4/1966 | Hoyne | 242/78.6 |
| 3,527,425 | 9/1970 | Shumaker | 242/78.1 |
| 3,531,058 | 9/1970 | Birschkus | 242/78.1 |
| 3,593,938 | 7/1971 | Watt | 242/72 |
| 3,666,194 | 5/1972 | Gosnell | 242/72 |
| 3,815,839 | 6/1974 | Madachy | 242/72 |
| 3,840,197 | 10/1974 | Rodach | 242/78.3 |
| 3,860,188 | 1/1975 | Bradshaw | 242/55.21 |
| 3,899,142 | 8/1975 | Hodges | 242/75 |
| 4,004,750 | 1/1977 | Seagrave | 242/25.43 |

*Primary Examiner*—Edward J. McCarthy

*Attorney, Agent, or Firm*—Hill, Van Santen, Steadman, Chiara & Simpson

[57] ABSTRACT

Coil material such as reels of steel become telescoped when they are shipped or handled and a very difficult problem is presented to move them back to the original desired condition. Also, it is necessary to rewind coils of steel reels so that they are tightly wound. The present invention provides means for changing the telescoped condition back to the original reeled condition and also for rewinding the reel so that it is tight in a simple and inexpensive manner.

8 Claims, 6 Drawing Figures

51
53
61
52
57
81
164
10
114
141
142
80
163
111
131
82
165
113
141
151
110
62
56
152
167
54
58
59
56
154
162
100
52
51
52
156

83
84
89
82
70
90
81
83
85

IV
182
183
93
87
83
91
89
84
88
92
82
90
70
81
180
181
85
IV

APPARATUS AND METHODS FOR UNTELESCOPING AND REWINDING REELS OF SHEET MATERIAL SUCH AS STEEL

BACKGROUND OF THE INVENTION

1. Field of the Invention

This invention relates in general to machines and apparatus for changing reels of sheet material as for example steel from a telescoped condition to its original reeled condition and also for rewinding the reel to remove any loose turns.

2. Description of the Prior Art

Coils of sheet steel when shipped via rail cars or trucks are subjected to impact loads caused by switching operations of the trains which tend to cause the coils to telescope which in turn breaks the steel banding straps around the reels. When the banding straps break, the outer laps of the coils unwind as a clock spring unwinds. Thus, it is common for coils of sheet steel to arrive at a destination with loose outer laps as well as being telescoped which makes it difficult if not impossible to handle as well as to use the steel.

SUMMARY OF THE INVENTION

The present invention provides machines and apparatus for converting the telescoped reels of steel back to the untelescoped condition as they were originally wound and which is desired as well as rewinding loose laps of a coil back to their original state. In the present invention, means are provided for applying force to a telescoped coil parallel to its center line so as to untelescope the coils and furthermore means are provided for clamping the outer end of the coil and rewinding the coil. Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 5:
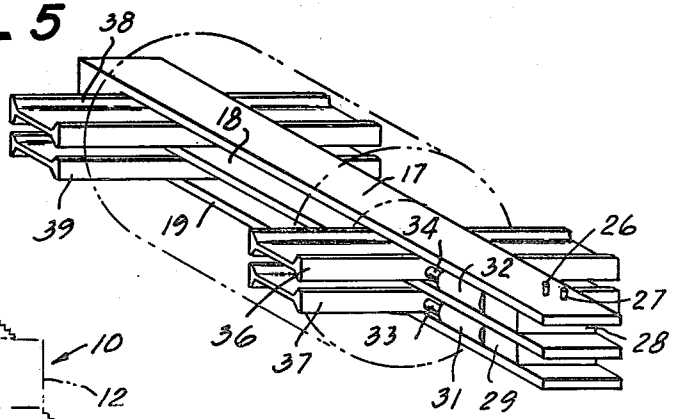
FIG. 5 illustrates a modified form of the invention for untelescoping coils.
Figure 6:
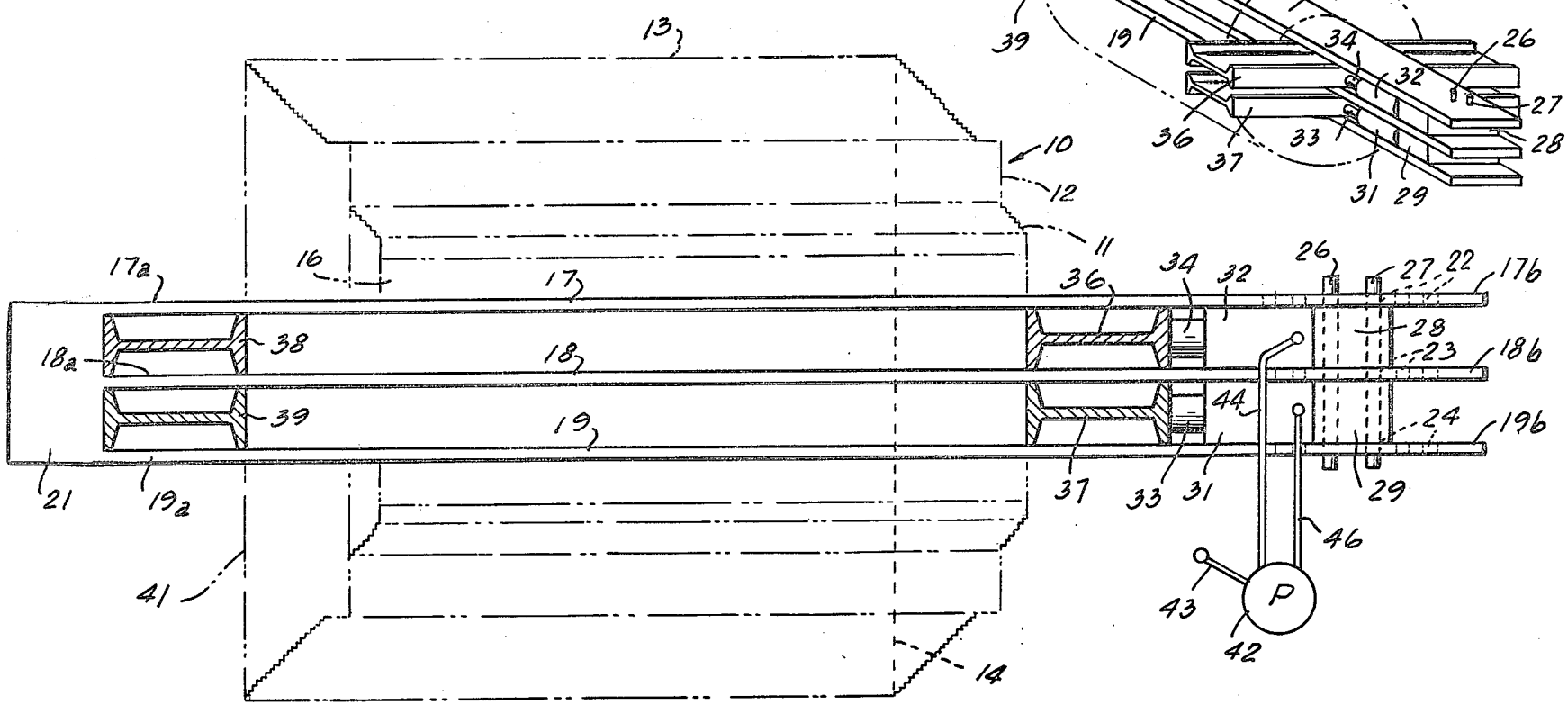
FIG. 6 is an additional view of the machine of FIG. 5 in position so as to untelescope a telescoped coil.

FIGS. 5 and 6 illustrate a reel 10 of coiled sheet metal such as steel which has become telescoped during shipping or handling such that center coils 11 and 12 extend to the right relative to FIG. 6 relative to the outer coil 13. The machine illustrated in FIGS. 5 and 6 applies force to the left relative to FIG. 6 to the inner coils 11 so as to move the inner coils 11 and 12 back in alignment with the outer coils 13 or until the ends of the coils 11 and 12 align with the dotted line 14 in FIG. 6.

The coil 13 has a central opening 16 through which draw bars 17, 18 and 19 are extended and which have their ends 17*a*, 18*a* and 19*a* commonly connected to a bolster 21. The members 17, 18 and 19 can either be flat with a plurality of predetermined spaced openings 22, 23 and 24 formed in the portion adjacent their second ends 17*b*, 18*b* and 19*b*, respectively, or alternatively, the members 17, 18 and 19 may be round and may be threaded or formed with concentric grooves to receive rings or split rings or the like. If they are threaded, they may receive suitable nuts that can be positioned at different positions along their portions adjacent the ends 17*b*, 18*b* and 19*b*. Alternatively, the members 17, 18 and 19 may have ratchet portions formed on their ends 17*b*, 18*b* and 19*b* or similar to a jack arrangement such that dogs may engage such ratchets as a holding means to allow axial tension force to be applied to the members 17, 18 and 19.

In the particular embodiment illustrated in FIGS. 5 and 6, the openings 22, 23 and 24 are adapted to receive pins 26 and 27 therein for holding anvils 28 and 29 that are mounted between the draw bars 17, 18 and 19. A pair of hydraulic rams 31 and 32 are supported by the anvils 29 and 28 and allow force to be exerted on pistons 33 and 34 which engage I beams 36 and 37. The I beams 36 and 37 extend transversely of the reel 10 of steel and engage the extending telescoping coils 11 to exert longitudinal force thereon as the hydraulic rams 31 and 32 extend the pistons 33 and 34 to untelescope coils of the reel 10. I-beams 38 and 39 are placed between the bolster 21 and the edge 41 of the reel 10 so as to provide a holding force against which the hydraulic rams 33 and 34 can work so as the I beams 36 and 37 are forced toward the I beams 38 and 39 as the pistons 33 and 34 are extended. The coils 11 and 12 will be forced back into alignment with the vertical lines 14 and 41 illustrated in FIG. 6.

A pump 42 has a control handle 43 for applying fluid through conduits 44 and 46 to the hydraulic rams 31 and 32 and for withdrawing fluid therefrom after the pistons 33 and 34 have been extended so that the cylinders 31 and 32 can be moved to the left relative to FIG. 6 by inserting the pins 26 and 27 in additional openings 22, 23 and 24 formed in the members 17, 18 and 19 to allow an additional stroke of the pistons until the reel 10 is in the proper alignment with all of the coils being aligned with edges 14 and 41 illustrated in FIG. 6.

It has been discovered that when longitudinal force is exerted by the I beams 36, 37, 38 and 39 that there is no set pattern as to which lap of the coil will be the first to move except it is known that the two laps with the least amount of friction between them will be the first to move relative to each other. In any event, force is continued to be exerted until the edges of all the coils are in alignment with each other and the pistons 33 and 34 may be retracted when their full throw has been used up and the anvils 28 and 29 may be moved to the left relative to the Figure to allow repeating of the process until the alignment has been finished.

Thus, the machine illustrated in FIGS. 5 and 6 allows untelescoping of coils which have become telescoped during shipping or otherwise.

FIGS. 1 through 4 illustrate a modification of the invention for correcting telescoping coils as well as rewinding coils which have become loosened.

Figure 1:
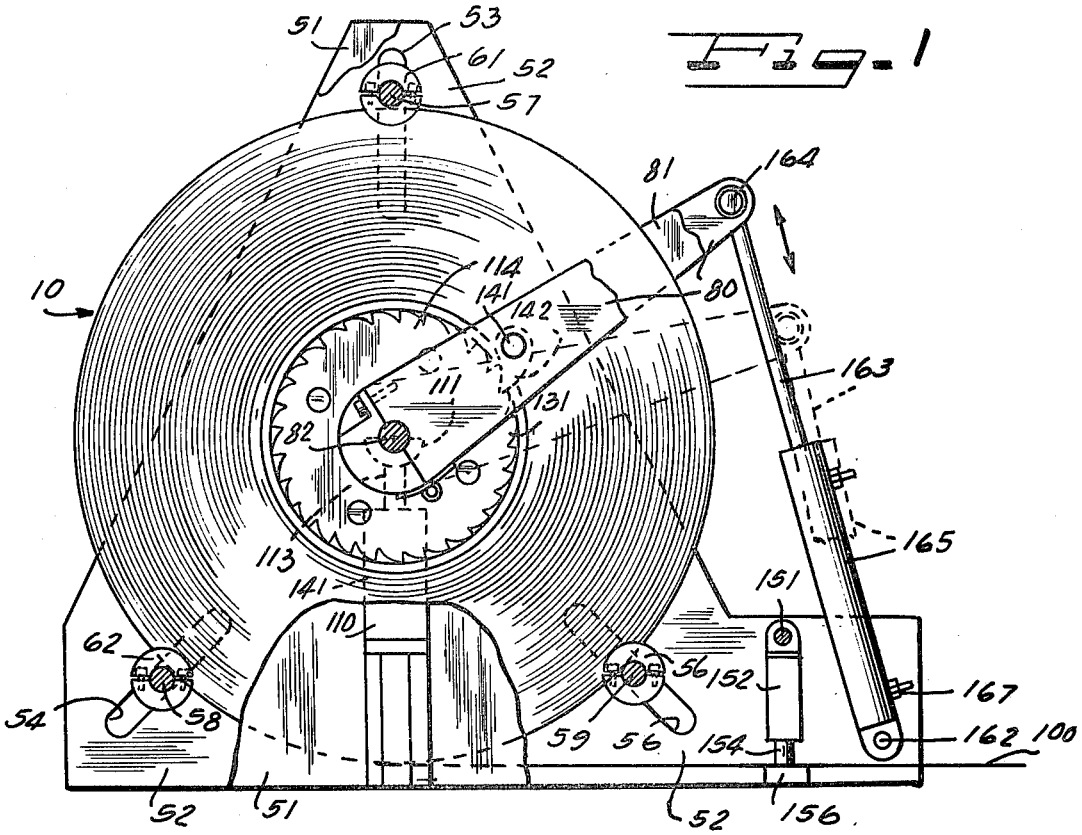
FIG. 1 illustrates an end-plan view of the rewinding and untelescoping machine of the invention.
Figure 2:
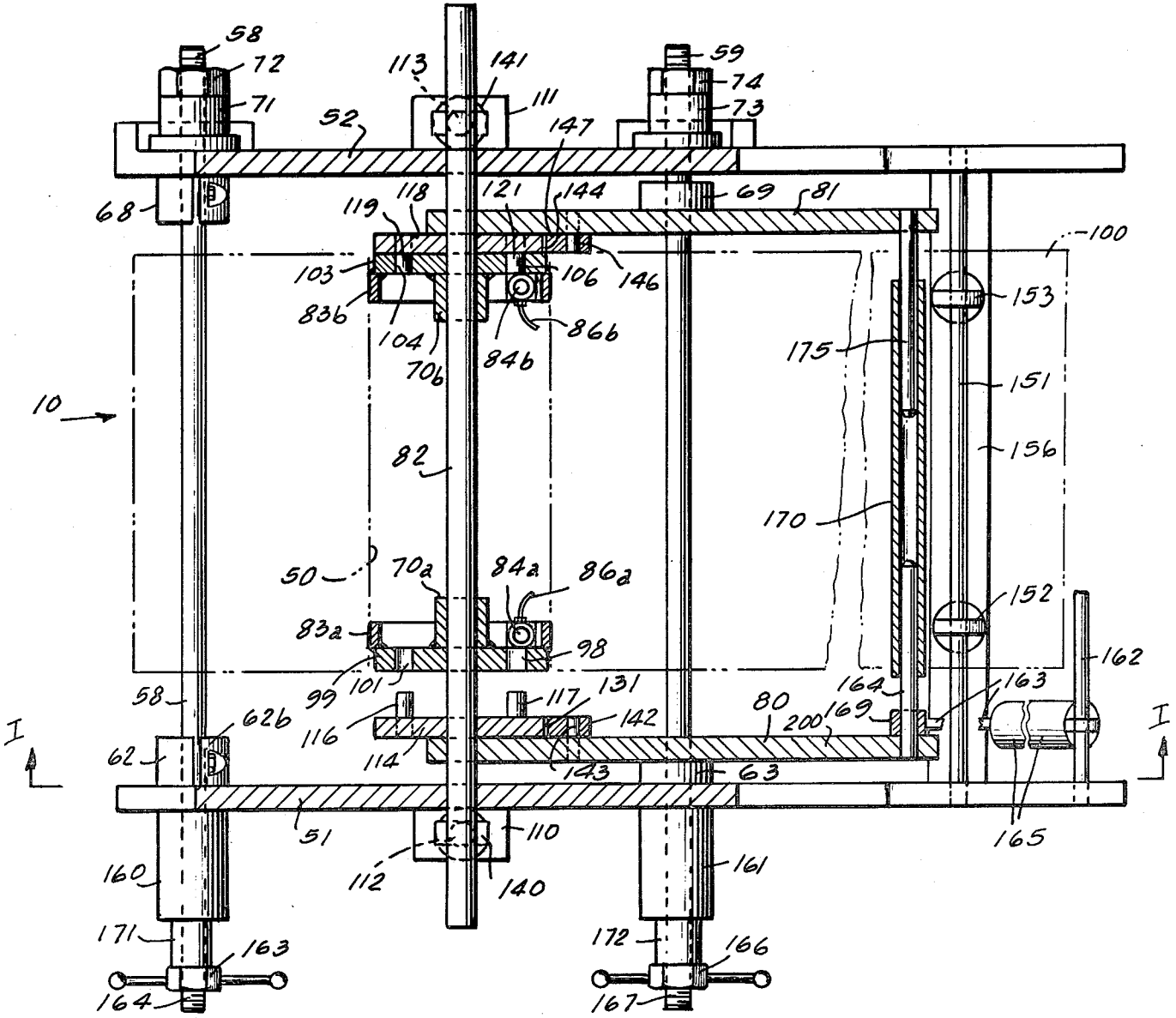
FIG. 2 is a top sectional view of the machine illustrated in FIG. 1.

As shown in FIGS. 1 and 2, a pair of generally triangular shaped side frame members 51 and 52 rest on a suitable base as, for example, the floor of a building and the reel 10 of coil metal is mounted between the side frame members 51 and 52. The tail 100 of the metal is clamped by a pair of hydraulic rams 152 and 153 to a cross member 156 which is connected to the frame members 51 and 52 as shown in FIGS. 1 and 2. The upper end of the rams 152 and 153 are supported on a shaft 151 and the piston 154 is shown in FIG. 1 as bearing against the tail 100 of the outer layer of the steel from reel 10 to hold it.

The side frame members 51 and 52 are lowered over the coil 10 by a crane with a spanner beam for proper space relationship with each other. While the crane supports the sides 51 and 52 in the upright position, draw bars 57, 58 and 59 are inserted through slidable collars 61 62, 68, 63, 69 which are moveable in slits 53, 54 and 56 as shown in FIG. 1. Half collars 62 and 68 are mounted on the inside of frame members 51 and 52 as shown in FIG. 2 about shaft 58. Half collrs 63 and 69 are mounted on the inside of frame members 51 and 52 as shown in FIG. 2 on shaft 59. Similar half collars are mounted on either ends of shaft 57. On the opposite side of frame member 52, a spacer collar 71 is mounted on shaft 58 and a nut 72 is threaded on the end 58 of shaft 58 as shown. Likewise, a collar 73 and nut 54 is threaded on shaft 59 and a similar holding means is mounted on the end of shaft 57. On the outer side of frame member 51, is mounted a hollow hydraulic ram 160 on shaft 58 and a nut 163 is threaded on the end 164 of shaft 58. Likewise, a hollow ram 161 is mounted on shaft 59 and a nut 166 is threaded on the end 167 of shaft 59. A similar hydraulic ram is mounted on shaft 57 in a similar relationship as are the rams 160 and 161. The rams 160 and 161 have pistons 171 and 172, respectively, which when extended by the application of hydraulic fluid to the hydraulic rams 160 and 161 move the end plates 51 and 52 toward each other so as to exert side compression on the reel 10 so as to untelescope the reel 10 in the event it has telescoped. In the position shown in FIG. 2, it is assumed that the reel has been untelescoped and after this has occurred the rams 160 and 161 and the corresponding ram, not shown, on shaft 57 are actuated to move the plates 51 and 52 far enough away from the sides of the reel 10 so that the coil can be rewound with the mechanism of the invention.

Figure 4:
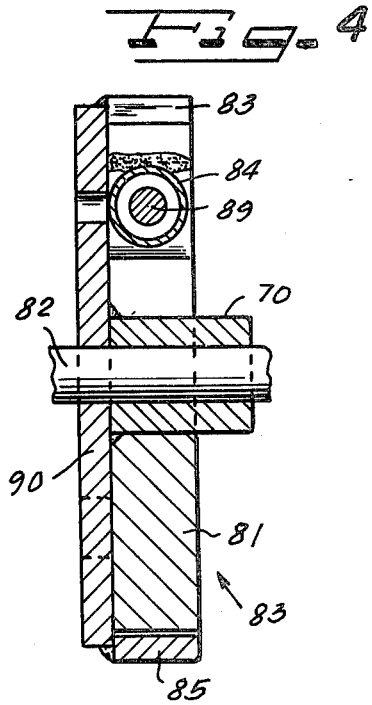
FIG. 4 is a sectional view taken on line IV—IV of FIG. 3.
Figure 3:
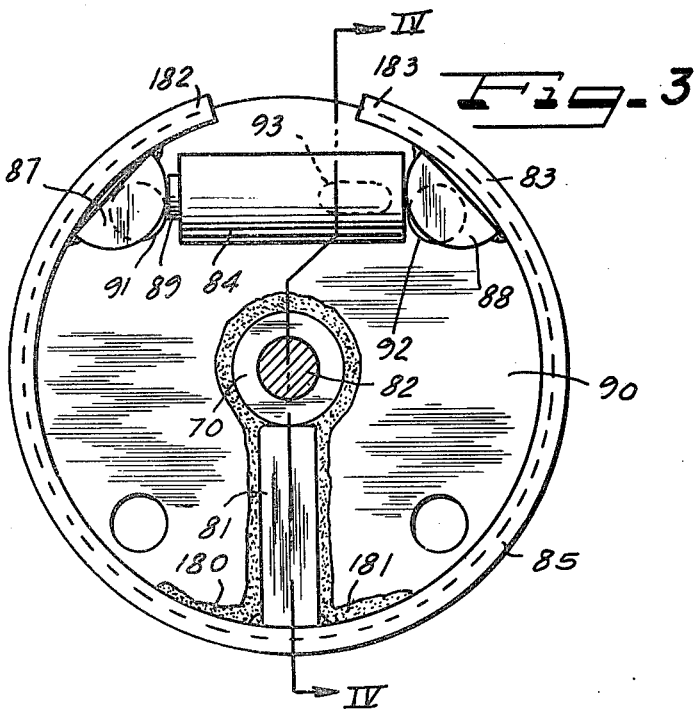
FIG. 3 illustrates an expanding inner shoe of the invention.

A pair of hydraulic rams 140 and 141 have pistons 112 and 113 which support half collars 110 and 111 which support a central shaft 82 which extends through the opening formed in the reel 10. A pair of expanding arbors **83*a* and 83*b* have collars 70*a* and 70*b* which fit over shaft 82 as shown and are placed inside the central opening of reel 10. FIGS. 3 and 4 illustrate one of the arbors 83 in detail and they are formed similar to a brake shoe arrangement with a central hub 70 through which the shaft 82 extends. A disc shape member 90 is attached to the hub 70 and to the rim 85 by welding 180 as shown in FIG. 3. A spoke strengthening structure 81 is also welded from the hub 70 to the rim 85 but the rim 85 is not welded to the disc 90 in portions away from the welded areas 180 and 181 so that the rim at portions 182 and 183 can be expanded by a hydraulic cylinder 84. The hydraulic cylinder 84 has a piston 89 and opposite ends of the cylinder 84 and the piston 89 are connected to anvils 87 and 88. A slot 93 is formed in the disc 90 for connecting and disconnecting of hydraulic hose to cylinder 84. After two of the expanding arbors or hubs 83 illustrated by 83*a* and 83*b* in FIG. 2 are inserted into the central opening 50 of the reel 10, they are expanded by applying hydraulic fluid to the pistons so as to grip the interior surface of said opening. The gusset or web 81 serves to interconnect rim 85, hub 70 and disc 90**.

As best shown in FIG. 2, the reel 10 can be rewound by a pair of arms 80 and 81 which are pivotally supported on the shaft 82 and extend outwardly and carry pins 164 and 175 at their outer ends upon which a sleeve 170 is mounted. A hydraulic cylinder 165 has its lower end pivotally supported on a shaft 162 and its piston 163 is pivotally connected to the extending end 200 of arm 80 and has a collar 169 which fits about the shaft 164 as shown in FIGS. 1 and 2.

A second arm 81 is also attached to shaft 82 and to projection 175 which fits in sleeve 170 as shown in FIG. 2. Gears 114 and 118 are mounted on shaft 82 and have pins 116 and 117 receivable in openings 101 and 98 of member 99 which is attached to member **83*a*. The gear 118 has pins 119 and 121 which are receivable in openings 104 and 106 which is attached to member 83*b*. A dog or pawl 142 is pivotally connected by pin 143 to the arm 80 and has an end which is engageable with the teeth 131 of gear 114 so as to drive the member 83*a*. Likewise, a pawl 147 is mounted on a pin 146 connected to arm 81 and has an end which engages teeth 144 of gear 118 so as to drive member 83*b* as the cylinder 161** is extended and contracted.

In operation, the reel 10 is first untelescoped by placing the side frame members 51 and 52 over the reel and the nuts 72 and 163, 166 and 74 and the associated nuts on shaft 57 are tightened and then the hydraulic cylinders 160, 161 and the associated cylinder on shaft 57 are extended so as to force the turns of the reel 10 back into the untelescoped condition.

After this has been done, the side frame members 51 and 52 are spaced away from the reel 10 as shown in FIG. 2 so that the arms 80 and 81 can move relative to the side frame members and the piston 165 is extended and contracted so as to cause the outside of the reel through the action of the members **83*a* and 83*b* to tighten. Each time the cylinder 165 extends the piston shaft 163 and draws it into the piston cylinder 165 the pawls 142 and 147 will further tighten the reel. The cylinder means 152 and 153 hold the tail end 100 of the outer turn of the reel 10** and after the reel has been both untelescoped and tightened it can be restrapped and prepared for shipment.

Although the invention has been described with respect to preferred embodiments it is not to be so limited as changes and modifications can be made therein which are within the full intended scope as defined by the appended claims.

I claim as my invention:

1. Apparatus for rewinding reeled material having a central opening comprising a pair of side frame members, a central shaft connected to said frame members and extendible through said central opening of said reeled material, means for clamping the outer end of said reeled material, and means for rotating the inner coil of said reeled material so as to tighten said reel, and wherein said clamping means comprises a hydraulic ram engageable with said outer end.

2. Apparatus for rewinding reeled material having a central opening comprising a pair of side frame members, a central shaft connected to said frame members and extendible through said central opening of said reeled material, means for clamping the outer end of said reeled material, and means for rotating the inner coil of said reeled material so as to tighten said reel, and including a pair of adjustable support means mounted adjacent said pair of side frame members and engageable with said central shaft to rotatably support said reeled material.

3. Apparatus for rewinding reeled material having a central opening comprising a pair of side frame members, a central shaft connected to said frame members and extendible through said central opening of said reeled material, means for clamping the outer end of said reeled material, and means for rotating the inner coil of said reeled material so as to tighten said reel, and including an expandible arbor receivable within said central opening of said reeled material, said central shaft extending through said arbor, and means for expanding said arbor.

4. Apparatus according to claim 3 including a pair of expandible arbors through which said central shaft extends and hydraulically expanded within said central opening of said reeled material.

5. Apparatus according to claim 4 wherein at least one of said arbors has a gear attached thereto, and means engaging said gear to drive it.

6. Apparatus according to claim 5 wherein said means for driving said gear comprises an arm pivoted on said central shaft, a dog pivotally connected to said arm, and hydraulic means for moving said arm to tighten said reeled material.

7. Apparatus according to claim 6 including second, third and fourth shafts extending between said pair of side frame members and engageable with the outer edges of said reeled material.

8. Apparatus according to claim 7 including hydraulic means attached to said second, third and fourth shaft to move said pair of side frame members together to untelescope said reeled material.

* * * * *